United States Patent [19]

Heydner

[11] 4,159,155

[45] Jun. 26, 1979

[54] BIMETAL CIRCUIT BREAKER

[75] Inventor: Konrad Heydner, Altdorf, Fed. Rep. of Germany

[73] Assignee: Ellenberger & Poensgen GmbH, Altdorf, Fed. Rep. of Germany

[21] Appl. No.: 871,932

[22] Filed: Jan. 24, 1978

[30] Foreign Application Priority Data

Jan. 25, 1977 [DE] Fed. Rep. of Germany ..... 2702851

[51] Int. Cl.[2] ..... H01H 61/06

[52] U.S. Cl. ..... 337/89; 337/111; 337/379

[58] Field of Search ..... 335/51, 52, 53, 85, 335/89, 92, 111, 342, 365, 369, 372, 343, 55

[56] References Cited

U.S. PATENT DOCUMENTS

| | | | |
|---|---|---|---|
| 3,238,780 | 3/1966 | Doyle | 337/379 |
| 3,718,162 | 2/1973 | Dafler et al. | 337/111 |
| 3,805,207 | 4/1974 | Grimshaw | 337/89 |

FOREIGN PATENT DOCUMENTS

| | | | |
|---|---|---|---|
| 1105505 | 12/1961 | Fed. Rep. of Germany | 337/89 |

*Primary Examiner*—Harold Broome
*Attorney, Agent, or Firm*—Spencer & Kaye

[57] ABSTRACT

A bimetal circuit breaker comprises a frame and a plate-like bimetal component which includes a base part, two U-shaped legs each having a first leg portion, a second leg portion and a U-shaped connecting portion. Each first leg portion is attached to the base part and diverges therefrom in a V shape. The circuit breaker further has a movable contact affixed to each second leg portion; a support tab attached to the base part and extending between the first leg portions; a support member attached to the frame and engaging a free end of the support tab for positioning the bimetal component in the frame; stationary contacts carried by the frame and cooperating with the movable contacts; and a rocker support held in the frame and engaging the base part in an over-the-center arrangement. The bimetal component and the rocker support have first and second stable positions in which the movable contacts are in engagement or out of engagement with the respective stationary contacts. The bimetal component and the rocker support are moved from the first stable position over the center and into the second stable position by the force generated by the deformation of the bimetal component caused by heat generated by an excess current passing through the bimetal component.

12 Claims, 3 Drawing Figures

Fig.1
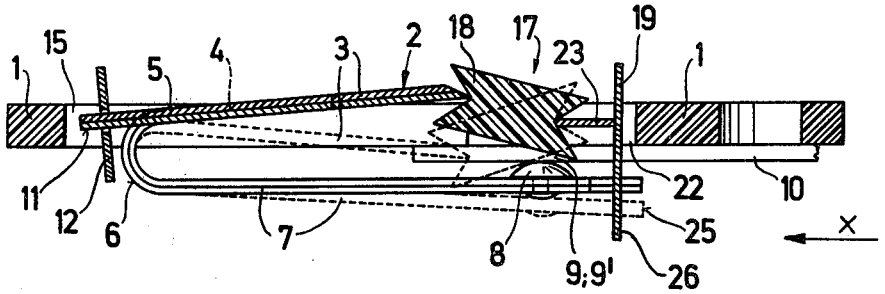
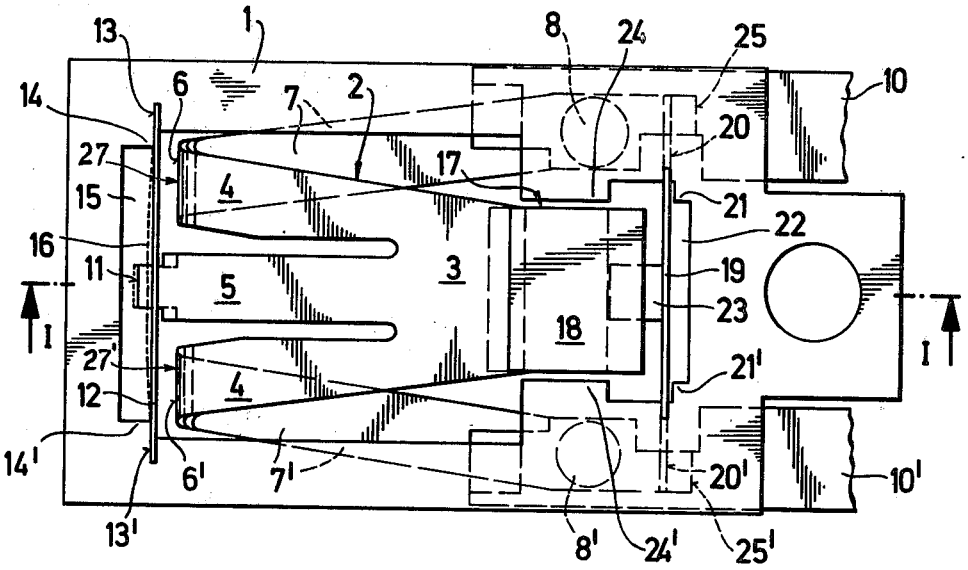
Fig.2
Fig.3
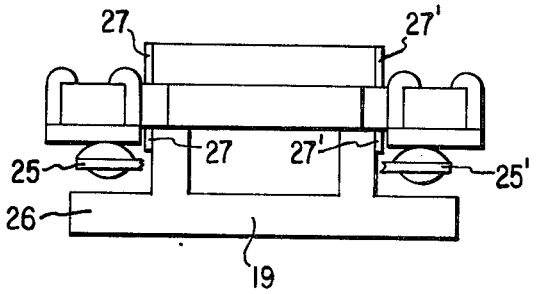

BIMETAL CIRCUIT BREAKER

BACKGROUND OF THE INVENTION

This invention relates to a bimetal circuit breaker for responding to excessive current by sensing the heat generated thereby. The bimetal component of the circuit breaker is, together with a rocker member, resiliently supported in a frame.

Circuit breakers of the above-outlined type are generally known and serve as excess current safety switches, for example, in motor circuits or the like. Their purpose is to open the circuit as soon as the effective current flowing therein exceeds the nominal current by a predetermined value for a predetermined period. The circuit-opening movement of the circuit breaker is achieved by virtue of a heat-caused deformation of at least one bimetal strip. The heat is, as a rule, generated by an auxiliary winding through which the current flows. Such thermal excess current circuit breakers are described, for example, in German Pat. No. 1,105,505.

SUMMARY OF THE INVENTION

It is an object of the invention to provide an improved bimetal circuit breaker having a reduced number of parts and a simplified structure.

This object and others to become apparent as the specification progresses, are accomplished by the invention, according to which, briefly stated, the bimetal circuit breaker comprises a frame and a plate-like bimetal component which includes a base part, two U-shaped legs each having a first leg portion, a second leg portion and a U-shaped connecting portion. Each first leg portion is attached to the base part and diverges therefrom in a V shape. The circuit breaker further has a movable contact affixed to each second leg portion; a support tab attached to the base part and extending between the first leg portions; a support member attached to the frame and engaging a free end of the support tab for positioning the bimetal component in the frame; stationary contacts carried by the frame and cooperating with the movable contacts; and a rocker support held in the frame and engaging the base part in an over-the-center arrangement. The bimetal component and the rocker support have first and second stable positions in which the movable contacts are in engagement or out of engagement with the respective stationary contacts. The bimetal component and the rocker support are moved from the first stable position over the center and into the second stable position by the force generated by the deformation of the bimetal component caused by heat generated by an excess current passing through the bimetal component.

A circuit breaker constructed in the above-outlined manner is thus essentially formed of a frame which is made in a known manner of an insulating material such as a thermosetting plastic or a ceramic material and in which the bimetal component and the rocker support are resiliently held and which carries the stationary contacts. The structure of the circuit breaker according to the invention is substantially simplified as compared to known devices; as a result, the circuit breaker may have very small dimensions (for example, 20×25 mm). The V-arrangement of the two U-shaped legs with respect to one another (they act as a contact bridge) provides a three-point clamping for the contacts to the clamping point of the rocker member, resulting in an equalization of the contacting forces.

The support tab arranged between the U-shaped legs of the bimetal component is preferably medially supported in a resilient holder strip which engages the frame with its opposite forked ends. This structural component too, is of very simple design and may be manufactured by simple stamping. During assembly, the resilient holder strip is, with the aid of its forked ends, simply pushed into the frame where it forms a resilient, bridge-like component. The springing support constituted by the resilient holder strip provides for a longitudinal displacement of the plate-like bimetal component and thus the interengaging contacts upon actuation of the circuit breaker. In this manner, a self-cleaning of the contacts is achieved, resulting in an increased reliability of the switching operation.

In order to limit the displacement (stroke) of the legs and to provide a stop for the return motion, according to a feature of the invention, the U-shaped legs have beyond the respective movable contacts they carry on their second leg portions, extensions which project into an abutment support. In the alternative, the same result can be achieved by two arms which are connected to the rocker support and which extend, as contact stroke limiting devices, beyond the ends of the U-shaped legs. Both solutions are about equally efficient and economical.

With regard to the manufacture of the bimetal component and the support tab, it has been found advantageous to form these parts as a one-piece member. In such a case, the bimetal component may be manufactured by simple stamping. It is, however, feasible to solder or weld the support tab separately, in which case it may be made of a material that is non-responsive to temperature changes.

According to a further feature of the invention, the rocker support is formed of a rocker member and a resilient support strip held at its ends in the frame. The rocker member which is arranged between the base part of the bimetal component and the resilient support strip, is centered between two frame projections oriented towards one another. In this manner, it is ensured by very simple means that the rocker member is movable practically without resistance. Thus, the rocker member may flip from one stable state into the other, but is, nevertheless, prevented from executing lateral excursions.

BRIEF DESCRIPTION OF THE DRAWINGS

FIG. 1 is a schematic sectional side elevational view of a preferred embodiment of the invention taken along line I—I of FIG. 2.

FIG. 2 is a top plan view of the same embodiment.

FIG. 3 is a schematic side view of the embodiment according to FIG. 1 in direction of arrow "X".

DESCRIPTION OF THE PREFERRED EMBODIMENT

Turning now to the Figures, all the components of the circuit breaker shown therein are inserted into a flat frame 1 made of an electrically insulating material, such as ceramic or a thermosetting plastic. In the frame 1 there is inserted a plate-like bimetal component 2 which is formed of a flat, planar base part 3, as well as a U-shaped leg 27 and a U-shaped leg 27'. The U-shaped legs 27 and 27' have, respectively, first leg portions 4 and 4', second leg portions 7 and 7', as well as bent connecting portions 6 and 6'. The U-shaped legs 27 and 27' are, with the respective leg portions 4, 4', attached to the base part 3 of the bimetal component 2 to form an integral portion thereof. The leg portions 4, 4' extend from the base part 3 of the bimetal component 2 in a V-shaped diverging manner. Between the legs 4 and 4' there is arranged a support tab 5 which too, is attached to the base part 3 of the bimetal component 2. The free ends of the leg portions 7 and 7' of the two U-shaped legs 27 and 27' carry respective contact members 8 and 8'. The contact members 8, 8' (movable contacts) normally engage (thus, in the closed state of the circuit breaker) respective counter-contact members (stationary contacts) 9, 9' which are attached to respective terminal leads 10 and 10' extending outwardly of the circuit breaker for external connections.

As seen in FIG. 1, the base part 3 of the bimetal component 2 is inserted in the frame 1 at a slight inclination thereto, so that the base part 3 forms an acute angle with the plane of the frame. The plane of the "U" of each U-shaped leg 27 and 27' is oriented perpendicularly to the main plane of the frame 1. The main plane of the frame 1 is parallel to the plane of the drawing FIG. 2. The support tab 5 has a narrowed end portion 11 which projects into a complemental slot provided medially in a resilient, leaf-like holder strip 12. The latter has forked ends 13 and 13' with which it is inserted on the frame 1. Offset frame portions 14 and 14' of the frame 1 provide a clearance 15 behind the holder strip 12 to permit the latter to undergo a resilient deformation as shown in dash-dot lines 16 in FIG. 2.

The base part 3 of the bimetal component 2 is, at its end remote from the support tab 5, held in a rocker support 17 formed of a rocker part 18 and a resilient holder strip 19. The latter has forked ends 20 and 20' for straddling the frame 1 similarly to the holder strip 12. This side of the frame also has offset portions 21 and 21' which can be engaged by the holder strip 19 and which provide, behind the holder strip 19, a clearance 22 into which the holder strip 19 may resiliently deform. The holder strip 19 supports the rocker part 18 by means of a tab 23 which connects the strip 19 with the rocker part 18.

The rocker part 18 which is made of an insulating material such as a thermosetting plastic, has, as seen in section in FIG. 1, oppositely located V-shaped grooves. The rocker part 18 is tiltably arranged between the base part 3 and the tab 23 (which, with their respective ends, engage into the one and the other V-shaped groove of the rocker part 18) and assumes its inclined position in the closed state of the circuit breaker as shown in solid lines in FIG. 1. In order to prevent the rocker part 18 from moving laterally, the frame 1 comprises centering projections 24 and 24' (FIG. 2).

Referring now particularly to FIG. 1, in the normal state of the circuit breaker, that is, in the cold condition of the bimetal component 2, the movable contact members 8 and 8' engage the respective stationary contact members 9, 9' carried on the terminal leads 10 and 10', respectively. In this state of the circuit breaker, current may flow, since the circuit is closed by the path formed, for example, by the terminal lead 10, the stationary contact member 9, the movable contact member 8, the free end 7, the leg portion 4, the leg portion 4', the free end 7', the movable contact member 8' the stationary contact member 9' and the terminal lead 10'.

If now the current flowing through the bimetal component 2 exceeds the nominal current, the bimetal component heats up and deforms in such a manner that the legs 27 and 27' move towards one another. Such a motion is possible only if accompanied by a downward motion of the base part 3 of the bimetal component 2, overcoming the resilient force of the holder strip 12. During this displacement, the rocker member 18 pivots counterclockwise (as viewed in FIG. 1) and after passing the dead center, it flips into its other stable position shown in phantom lines in FIG. 1. This change of position is greater than the thermal deformation of the bimetal component, so that the leg portions 7 and 7' are likewise brought into their position shown in phantom lines in FIG. 1. As a result of this displacement, the movable contact members 8 and 8' move out of engagement with their associated stationary contact members 9, 9', resulting in an opening of the circuit. Since now the current flow is interrupted, the bimetal component 2 undergoes cooling, resulting in an assumption of its original configuration. Thus, the 27, 27' legs spread away from one another. During this occurrence, the terminus of each leg portion 7 and 7' engages, for example, by means of an extension 25, the abutment support 26 (which is constituted by an end of a closed slot provided in the holder strip 19); as a result, the rocker part 18 snaps back from its phantom-line position into its full-line position as shown in FIG. 1. Consequently, the movable contact members 8 and 8' again engage their associated stationary contact members 9 and 9', once again closing the electric circuit. The holder strip 19 is fixed to the frame 1 by the U-shaped legs 27 and is provided with the abutment supports 26. When responding, the extension 25 of the free leg portions 7 and 7' resp. of the bimetal component 2 engages the abutment supports 26. The distance between the extension 25 and the abutment supports is constructed to automatically effect a spring back in case the bimetal component cooled down. If there is a greater distance, the bimetal component remains in "out"-position after having responded, from which it can only be removed by hand re-setting.

Thus, in the bistable over-the-center arrangement of the assembly formed of the bimetal component 2, the rocker support 17 and the resilient holder strips 12 and 19, the lamination of the bimetal component 2 is so oriented that upon heating of the bimetal component 2, the legs 27 and 27' deform towards one another. The angle of the rocker member 18 to the plane of the frame 1 in the two limit positions is sufficiently large to ensure that these limit positions are stable ones. The length of the legs 27, 27' is so dimensioned that an over-the-center displacement and a secure contact breaking or contact making is achieved upon the predetermined heating and, respectively, cooling of the bimetal component 2.

It will be understood that the above description of the present invention is susceptible to various modifications, changes and adaptations, and the same are intended to be comprehended within the meaning and range of equivalents of the appended claims.

What is claimed is:

1. A bimetal circuit breaker comprising:

(a) a frame;

(b) a plate-like bimetal component including (1) a base part;

(2) two U-shaped legs each having a first leg portion, a second leg portion and a U-shaped connecting portion; the first leg portions being attached to said base part and diverging therefrom in a V shape;

(c) a movable contact affixed to each said second leg portion;

(d) a support tab attached to said base part of said bimetal component and extending between the first leg portions of said U-shaped legs;

(e) a securing means attaching a free end of said support tab to said frame for positioning said bimetal component in said frame;

(f) stationary contacts carried by said frame and cooperating with said movable contacts; and (g) a rocker support movably held in said frame and engaging said base part of said bimetal component in an over-the-center arrangement; said bimetal component and said rocker support having a first stable position in which the movable contacts are in engagement with the respective stationary contacts; said bimetal component and said rocker support having a second stable position in which the movable contacts are out of engagement with the respective stationary contact; said bimetal component and said rocker support moving from said first stable position over the center and into said second stable position by the force generated by the deformation of said bimetal component caused by heat generated by an excess current passing through said bimetal component.

2. A bimetal circuit breaker as defined in claim 1, wherein each said stationary contact is attached to a terminal lead secured to said frame and extending away therefrom.

3. A bimetal circuit breaker as defined in claim 1, wherein the lamination of said bimetal component is oriented such that upon heating of said bimetal component said U-shaped legs move towards one another.

4. A bimetal circuit breaker as defined in claim 1, wherein the plane of the "U" of each U-shaped leg is oriented perpendicularly to the main plane of the frame.

5. A bimetal circuit breaker as defined in claim 1, wherein said support tab and said bimetal component constitute together a single-piece member.

6. A bimetal circuit breaker as defined in claim 1, wherein said securing means is constituted by a resilient holder strip and wherein said support tab is attached to the median part of said resilient holder strip.

7. A bimetal circuit breaker as defined in claim 6, wherein said resilient holder strip has forked opposite ends straddling opposite portions of said frame.

8. A bimetal circuit breaker as defined in claim 1, wherein said rocker support is formed of a resilient support strip attached to said frame and a rocker member pivotally held by and between said resilient support strip and said base part of said bimetal component.

9. A bimetal circuit breaker as defined in claim 8, wherein said support strip has abutment means cooperating with ends of said second leg portions.

10. A bimetal circuit breaker as defined in claim 8, wherein said support strip has two arms extending beyond free ends of said second leg portions for limiting the stroke of said second leg portions.

11. A bimetal circuit breaker as defined in claim 8, wherein said frame comprises two centering projections oriented to one another and wherein said rocker member is arranged between said centering projections for preventing lateral excursions of said rocker member during its pivotal motion.

12. A bimetal circuit breaker as defined in claim 8, wherein said rocker member has V-shaped first and second grooves on opposite sides thereof and wherein a portion of said base part projects into said first groove and a portion of said support strip projects into said second groove.

* * * * *